US005555643A

United States Patent [19]

Guasch

[11] Patent Number: 5,555,643

[45] **Date of Patent: * Sep. 17, 1996**

[54] METHOD AND APPARATUS FOR CREATING AIR FLOW IN A WALL OR CEILING FOR DRYING PURPOSES THROUGH AN ELECTRICAL BOX

[76] Inventor: James A. Guasch, 11441 Eastbrook Ave., Los Altos, Calif. 94024

[ * ] Notice: The portion of the term of this patent subsequent to May 30, 2012, has been disclaimed.

[21] Appl. No.: 452,270

[22] Filed: May 26, 1995

Related U.S. Application Data

[63] Continuation-in-part of Ser. No. 323,891, Oct. 17, 1994, Pat. No. 5,419,059.

[51] Int. Cl.[6] ..... F26B 3/00

[52] U.S. Cl. ..... 34/443; 34/104; 34/235; 15/405; 15/DIG. 7

[58] Field of Search ..... 34/104, 86, 443, 34/437, 235, 201, 239, 218, 90, 91; 15/405, 406, 414, DIG. 7, 334, 335, 336, 337, 338; 342/379–383; 126/271.1

[56] References Cited

U.S. PATENT DOCUMENTS

| | | | |
|---|---|---|---|
| 2,969,027 | 1/1961 | Figge | 34/104 |
| 3,052,987 | 9/1962 | Mercer | 34/104 |
| 5,155,924 | 10/1992 | Smith | 34/443 |
| 5,408,759 | 4/1995 | Bass | 34/104 |
| 5,419,059 | 3/1995 | Guasch | 34/443 |

*Primary Examiner*—John T. Kwon
*Attorney, Agent, or Firm*—Mallinckrodt & Mallinckrodt

[57] ABSTRACT

Apparatus for creating a flow of air in a hollow wall or ceiling to aid in drying a wall or ceiling which has become wet generally through a disaster such as broken pipes, flooding, leaking roof, includes a conduit having a first end sized and configured to fit and be secured over and around an opening in a wall or ceiling which has an electrical box mounted therein. The conduit will generally be provided with holes positioned to be aligned with the usual cover plate mounting holes in a wall switch or outlet, or fixture mounting holes in the box itself, through which screws can be positioned to effect securement of the conduit. A second end of the conduit is configured to accept the end of an air supply hose or a vacuum supply hose, such as extending from the outlet or the inlet, respectively, of a usual air blower, and an air flow passage extends from the second end to the first end to direct air into or draw air from the wall or ceiling through and around the electrical box. A sealing foam facilitates mounting of the conduit over electrical boxes of varying depth in the opening with screws of a set length.

17 Claims, 6 Drawing Sheets

METHOD AND APPARATUS FOR CREATING AIR FLOW IN A WALL OR CEILING FOR DRYING PURPOSES THROUGH AN ELECTRICAL BOX

RELATED APPLICATIONS

This application is a continuation in part of my application for U.S. patent application Ser. No. 323,891, filed Oct. 17, 1994, now U.S. Pat. No. 5,419,059.

BACKGROUND OF THE INVENTION

1. Field

The invention is in the field of methods and apparatus for drying building walls and ceilings, particularly hollow building walls and ceilings that have become undesirably wet through floods, pipe breakage, fire fighting, or other disasters.

2. State of the Art

It is current practice in drying hollow walls and ceilings that have become wet to direct a flow of air against such walls or along such walls and ceilings to draw water therefrom. In some cases an attempt is made to circulate air through the walls or ceiling. This is done by drilling or cutting holes or making slits in the walls or ceilings and directing air toward such holes or slits.

U.S. Pat. No. 5,155,924 discloses special diverters which can be placed over expansion slots in a floor or slots made by removing a portion of a floor, or over holes cut through a wall or ceiling to direct flowing air into the floor, walls, or ceiling through such holes. The holes that are made through the floor, walls, or ceiling, must be repaired after the drying process.

Electrical boxes which mount electrical switches and outlets to walls provide access to the inside of at least portions of the walls. The inventor has found that he can take off the face plate of electrical switches or outlets and then pull the switch or outlet clear of the box and direct the air from a blower toward the box to create some air flow into the wall. With air merely directed from a blower toward an electrical box, however, the transfer of air to the wall or ceiling is very inefficient.

SUMMARY OF THE INVENTION

According to the invention, air flow through a wall or ceiling for drying purposes can be enhanced by apparatus which can be secured over an electrical box to an electrical wall switch or an electrical outlet in the box in place of the normal face plate therefor or to an electrical box which serves as a mounting for electrical lighting fixtures in place of the lighting fixture and, as set forth in my parent application, to a source of pressurized air to provide a connection between the source of pressurized air and the wall or ceiling. The air enters the wall through the electrical box and flows through the wall to exit through any openings (such as other electrical boxes) or cracks in the wall. Most walls are not completely sealed and enough air flow occurs to effectively dry the walls. Alternately, rather than connecting the apparatus to a source of pressurized air to create a flow of air into the wall through the electrical box, the apparatus may be connected to a source of partial vacuum or suction to draw air from the wall through the electrical box. In such case, air enters the wall through the various openings or cracks and flows from the wall through the electrical box to the source of vacuum. The use of electrical boxes as inlets or outlets for air eliminates the need for cutting holes in walls or ceilings in order to induce air flow and thus eliminates the need for repair of such holes after drying is completed as is required with methods of the prior art. The apparatus of the invention includes a conduit body, which may be fabricated or molded of a plastic material, and which has a first end sized and configured to fit circumferentially around a given electrical box. A second end of the conduit body is configured to be attached to a source of pressurized air, such as to a hose extending from the output of the usual air blower used for drying purposes, or to a source of vacuum, such as to a hose extending from the input of the usual air blower used for drying purposes. An air flow passage extends from the second end through the conduit body and opens through the first end of the body to the electrical box.

Electrical boxes are generally installed in a wall or ceiling so that an open face of the electrical box extends through a hole or opening in the wall or ceiling and is usually substantially flush with an exposed surface of the wall or ceiling which surrounds the open face of the box. The conduit body includes means for securing it to an outlet or switch mounted in the electrical box or to the box itself so that the conduit body is secured over the box with the first end of the conduit body abutting the wall or ceiling surface around the box. The securing means will generally take the form of appropriately placed screw holes through the conduit body so that screws can be inserted to extend through the body into the normally provided threaded holes in a wall switch or outlet installed in a box or in the electrical box itself. When the second end of the conduit is attached to a source of pressurized air, the conduit provides a source of pressurized air at the face of the electrical box. When the second end of the conduit is attached to a source of a partial vacuum, the conduit provides a partial vacuum at the face of the electrical box. Either pressure or vacuum has been found very effective in creating a flow of drying air in a wall or ceiling. Since the source of pressurized air or vacuum generally can move a substantial volume of air, it is not necessary that the conduit body seal around the electrical box. It merely has to provide substantial restriction to the flow of air other than into or out of the box. Thus, the holes for the mounting screws can extend into and through the passage without substantially affecting the flow of air into or out of the box. Further, it is not necessary to provide sealing gaskets against the wall or ceiling, however, such gaskets may be provided, and if provided by a thickness of resilient material, may help compensate for variations in the placement of the electrical box within the opening in the wall or ceiling to facilitate installation of the device over the electrical box.

The conduit body may be made in various shapes and with various dimensions to fit specific electrical boxes, such as a separate fixture sized to fit over a single width electrical box with one model having two mounting holes spaced to position screws to screw into a wall switch in the box in place of the normal cover plate which is removed, and a second model having a single mounting hole spaced to position a screw to screw into a standard duplex electrical socket in place of the standard socket wall plate. Separate models can be made for double width electrical boxes and light fixture electrical boxes. Alternately, a single conduit body may be sized to fit around a variety of boxes with multiple screw holes located therethrough to provide for mounting to any of the variety of boxes.

The invention also provides a method of creating air flow through hollow walls or ceilings for drying purposes by providing apparatus to direct pressurized air into a wall or ceiling through or around existing electrical boxes or to draw air out of a wall or ceiling through or around existing electrical boxes.

THE DRAWINGS

The best mode presently contemplated for carrying out the invention is illustrated in the accompanying drawings, in which:

FIG. 1 is a perspective view of a room with a wall in need of drying and showing a standard drying blower with a special attachment plate of the invention used to connect hoses to the drying blower to direct air to electrical boxes in the wall through apparatus of the invention;

FIG. 2, a fragmentary vertical elevation of the special attachment plate on the blower taken through a hose on the line 2—2 of FIG. 1;

FIG. 3, a fragmentary vertical section taken on the line 3—3 of FIG. 2;

FIG. 4, a front elevation of an apparatus of the invention which fits over an electrical box with wall switch therein taken on the line 4—4 of FIG. 1, with the pressurized air hose and clamp omitted, and showing structure behind the apparatus in broken lines;

FIG. 5, a vertical section taken on the line 5—5 of FIG. 4, but showing the electrical box in elevation;

FIG. 6, a fragmentary perspective view of a portion of the wall of FIG. 1, with electrical box having an electrical wall switch therein and showing the apparatus of the invention adapted to fit over the single electrical wall switch and showing how it fits around the electrical box;

FIG. 7, a rear perspective view of the apparatus of the invention shown in FIGS. 4–6;

FIG. 8, a front elevation of an embodiment of the invention adapted to fit over a single electrical duplex outlet taken on the line 8—8 of FIG. 1, but with the pressurized air hose and clamp omitted, and showing structure behind the apparatus in broken lines;

FIG. 9, a vertical section taken on the line 9—9 of FIG. 8, but showing the electrical box in elevation;

FIG. 10, a front elevation of an embodiment of the invention adapted to fit over a double wall switch;

FIG. 11, a front elevation of an embodiment of the invention adapted to fit over a double electrical outlet;

FIG. 12, a front elevation of an embodiment of the invention adapted to fit over an electrical box to which electrical lighting fixtures are mounted;

FIG. 13, a horizontal section taken on the line 13—13 of FIG. 12;

FIG. 14, a front elevation of an embodiment of the invention adapted to fit over all of the various types of switches, outlets, and electrical boxes shown in the previous figures;

FIG. 15, a vertical section taken on the line 15—15 of FIG. 14;

FIG. 16, a horizontal section taken on the line 16—16 of FIG. 14;

FIG. 17, an enlarged fragmentary horizontal section of a portion of FIG. 16;

FIG. 18, a rear perspective view of the apparatus of FIGS. 14–17;

FIG. 19, a front perspective view of the apparatus of FIGS. 14–17;

FIG. 20, a perspective view of a room similar to that shown in FIG. 1 with a wall in need of drying and showing a standard drying blower with special attachment plates of the invention used to connect hoses to the input of the drying blower to draw air from the electrical boxes in the wall through apparatus of the invention;

FIG. 21, a fragmentary vertical elevation of the special attachment plate on an inlet of the blower taken on the line 21—21 of FIG. 20;

FIG. 22, a perspective view of an alternate embodiment of the conduit of the present invention showing an elastomeric foam seal; and FIG. 23, a vertical section through the embodiment of FIG. 22, and showing the conduit attached to an electrical box.

DETAILED DESCRIPTION OF THE ILLUSTRATED EMBODIMENTS

Figure 1:
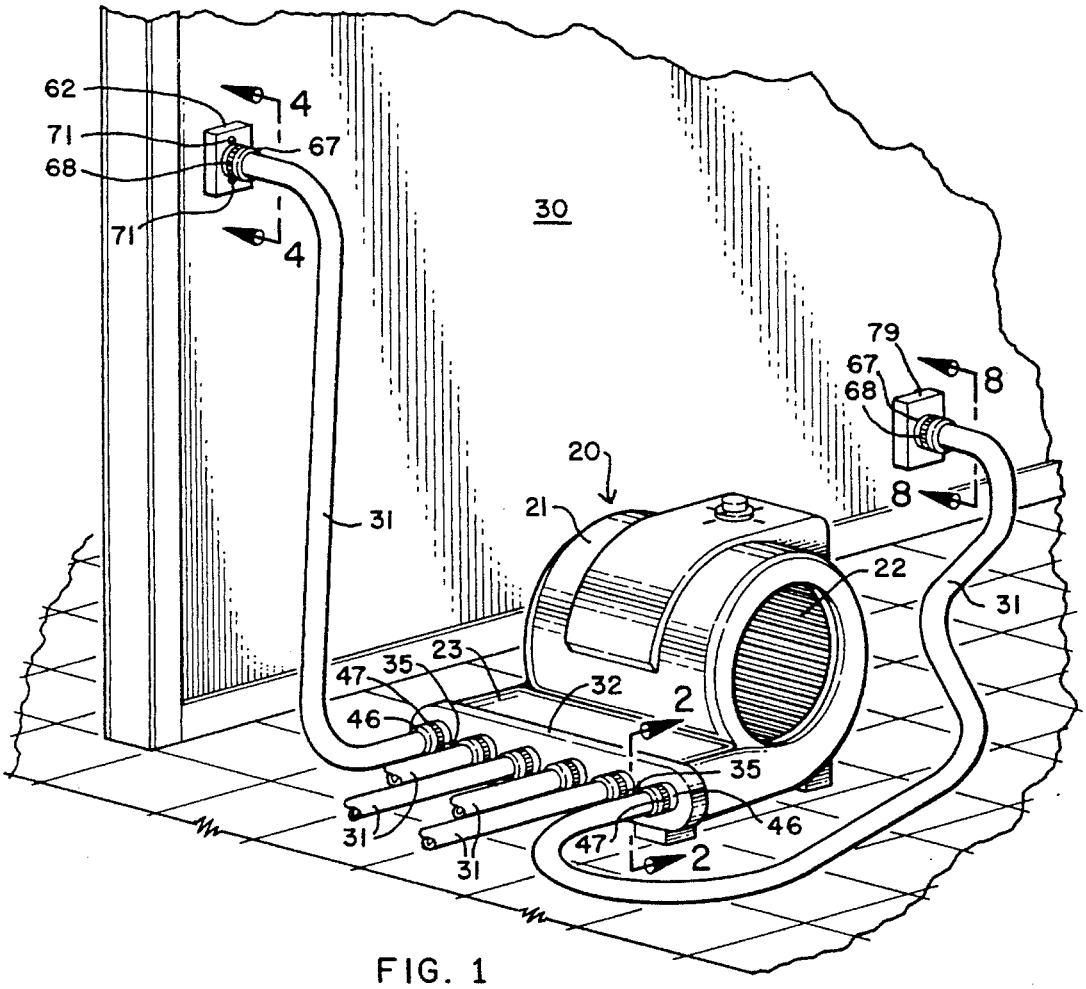
Figure 3:
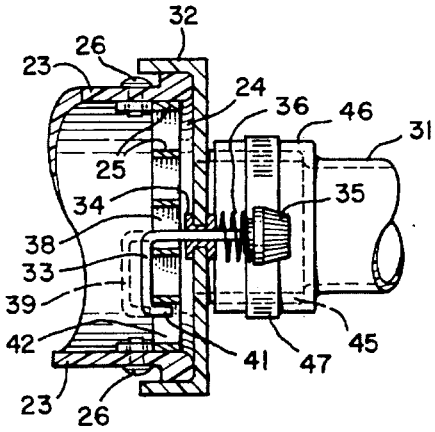
Figure 2:
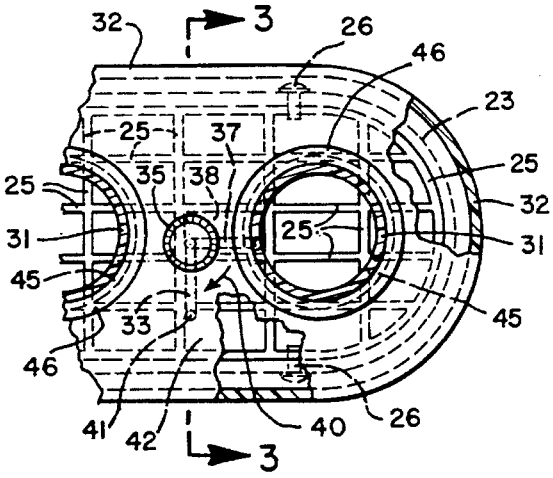
Figure 20:
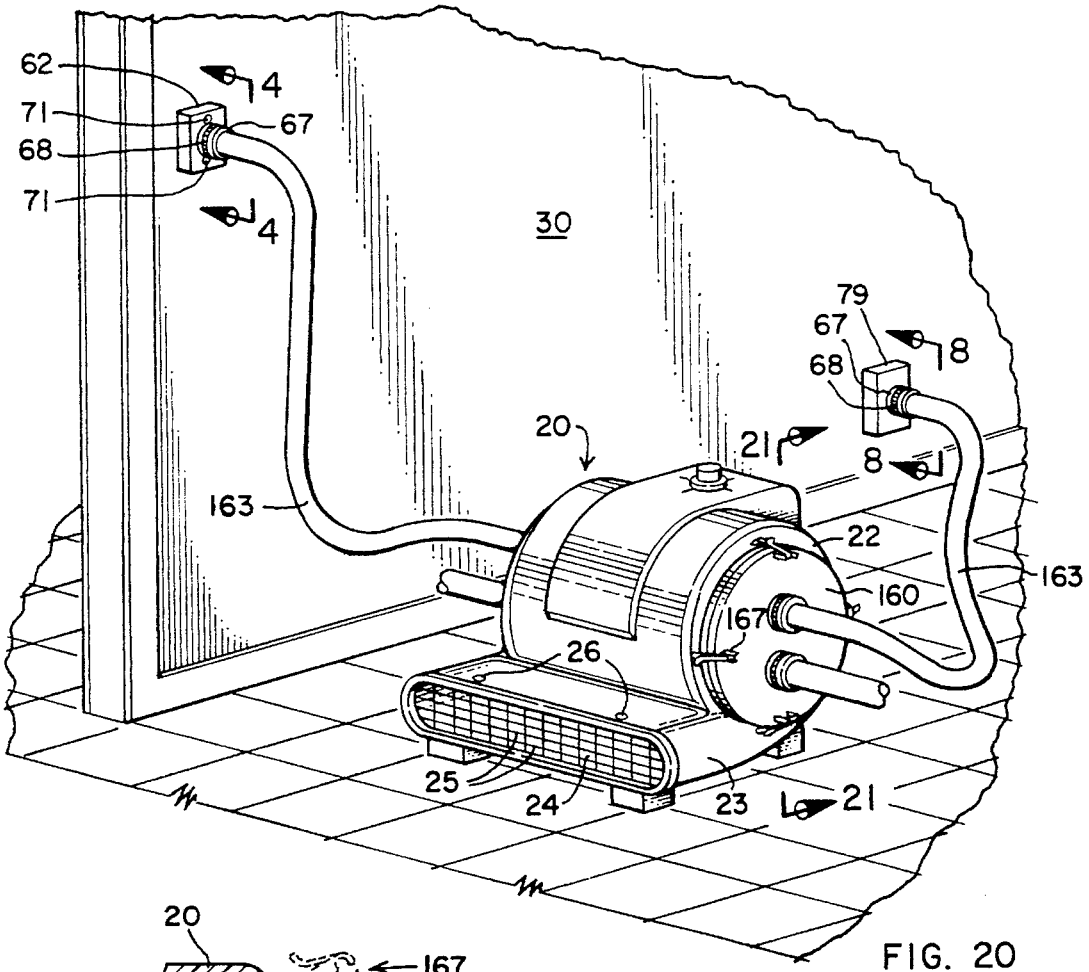

A standard, commercially available blower unit 20, FIGS. 1 and 20, as used to circulate air in a room or blow air against or along a wall, floor, or ceiling for drying purposes includes a housing 21, an air intake opening 22, and an air outlet duct 23 with outlet opening 24, FIGS. 2 and 3. A grate 25 is secured in outlet opening 24 by screws 26. In normal operation of blower unit 20, air outlet duct 23 is directed to the portion of a room where air flow is desired and the air exits the blower through outlet opening 24 and grate 25. For example, if wall 30 had become wet because of a broken pipe in the ceiling above the wall or because of a flood, the blower outlet duct would be directed toward wall 30.

For use with the pressure embodiment of the invention, it is desirable to have the air from the blower carried by hoses 31 to apparatus of the invention which fits over electrical boxes mounted in a wall or ceiling to provide pressurized air to such boxes. For this purpose, a hose mounting plate 32, FIGS. 1–3, is placed over outlet opening 24 and is held in place by J-shaped locking members 33, FIG. 3, the stem of which rotatably pass through bearings 34 and have a knob 35 on the end thereof so that knob 35 is accessible to a user. A locking member 33 is positioned at each end of plate 32, one of which is shown in FIGS. 2 and 3. The locking member at the other end of plate 32 is identical. A spring 36 is positioned between plate 32 and knob 35 to bias knob 35 and J-shaped locking member 33 outwardly which biases the lower web portion of the J toward plate 32. With this arrangement, plate 32 may be easily secured over the blower outlet by turning the locking member so that the lower web portion of the J extends along the long axis of the plate 32 as indicated at 37 in FIG. 2 where it can be pushed through an opening 38 in grill 25. With plate 32 over outlet duct 23, knob 35 can be pushed inwardly against the bias of spring 36 to push the lower web portion of the J through opening 38 to the inward position 39 shown in broken lines in FIG. 3. In this inward position, member 33 can be rotated as shown by arrow 40, FIG. 2, to the locking position shown as 41 in FIG. 2. The knob 35 is released and spring 36 urges member 33 outwardly so that the lower web portion of J-member 33 abuts the grill as shown in solid lines in FIG. 3 with the outer hook portion of the J-member extending into grill opening 42. With locking members in locking position at both ends of plate 32, plate 32 is held securely across opening 24 in outlet duct 23.

Plate 32 has a number of nipples 45, FIGS. 2 and 3, extending therefrom over which an end 46 of a hose 31 may be placed and secured such as by clamps 47, FIGS. 1 and 3.

Plate 32 as shown in FIG. 1 has six nipples for the attachment of six separate hoses 31. These hoses can be directed to different portions of a room. Depending upon the size and output capacity of the blower 20, a plate 32 may provide for attachment of fewer than the six hoses. Further, where more nipples for hose attachments are provided than the desired number of hoses for a particular job, caps may be placed over the unused nipples.

Figure 21:
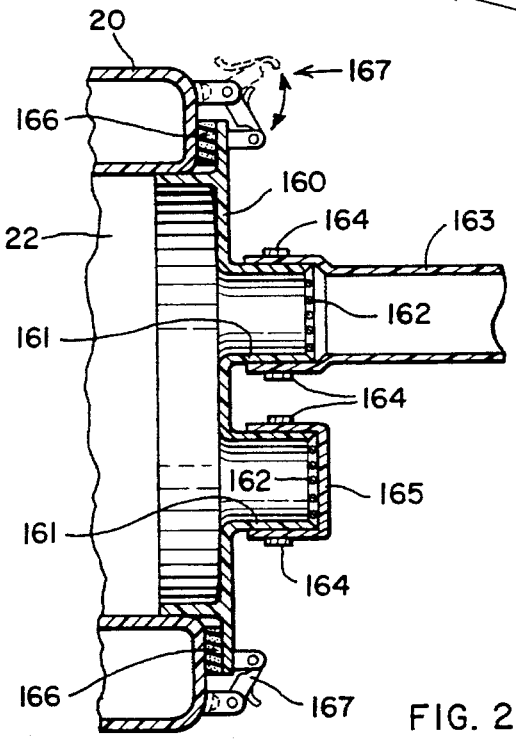

For use with the vacuum embodiment of the invention, it is desirable to have input air to the blower carried by hoses 163 from the apparatus of the invention which fits over electrical boxes mounted in a wall or ceiling to provide a source of partial vacuum to such boxes to draw air therefrom. For this purpose, hose mounting plates or manifolds 160, FIGS. 20 and 21, are fitted over the opposite air intakes 22 of blower unit 20. Only one air intake 22 is shown in FIG. 1, with one manifold over that intake in FIGS. 20 and 21, but a similar intake is generally provided on the opposite side of the blower unit 20, as indicated by the hoses 163 extending from such opposite side in FIG. 20.

The manifold 160 of the vacuum embodiment differs from the manifold of the pressurized air embodiment in that the manifold is shaped to fit over the air intake 22 of the blower 20 instead of over the air outlet duct 23 of the blower unit. The manifold has a number of nipples 161 for the attachment of hoses 163. The hoses may be secured in place by hose clamps 164. Intake screens 162, FIG. 21, trap any large objects that may be picked up by the partial vacuum in the hoses 163, thereby preventing any possible damage to the blower 20.

In the event that not all nipples 161 of a vacuum manifold 160 are used, extra nipples may be terminated with a cap 165. The manifolds 160 are generally equipped with elastomeric gaskets 166 that help ensure a seal between the intakes 22 of the blower 20 and the manifolds 160. The vacuum manifolds 160 are removably held in place on blower 20 by a set of spring clips 167.

Figure 6:
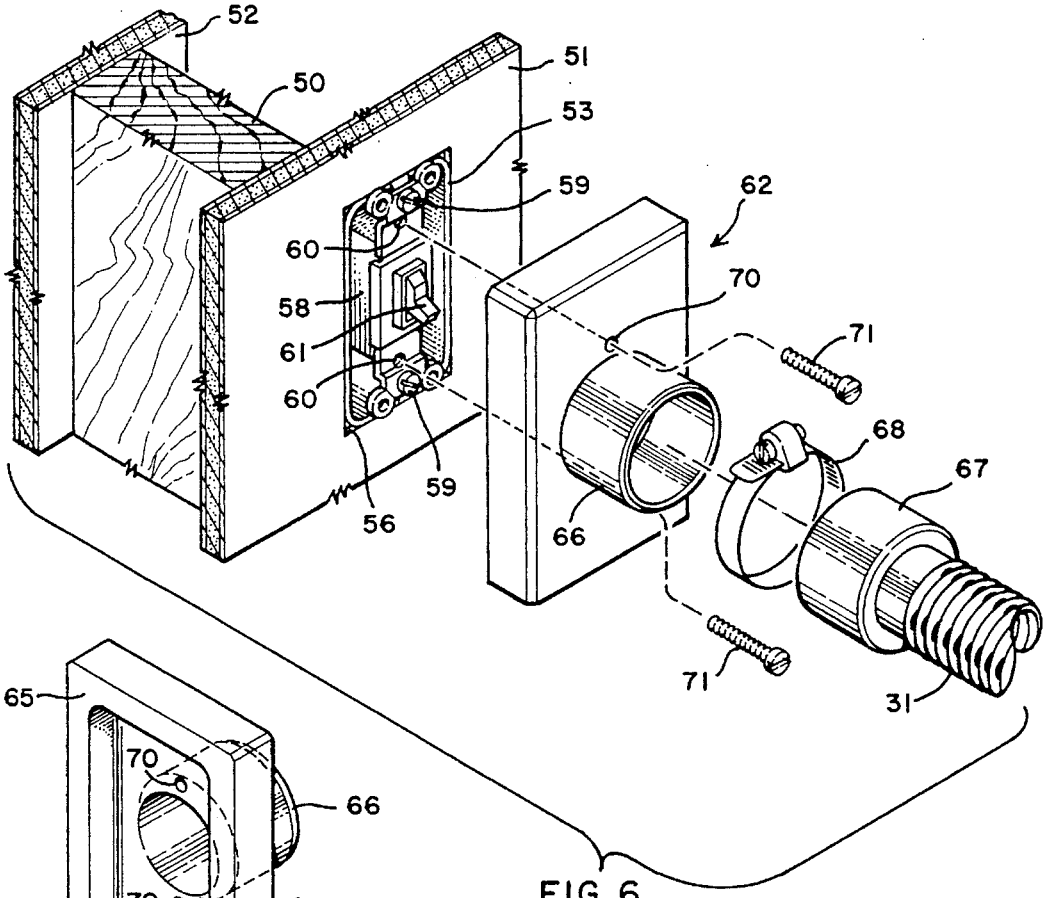
Figure 7:
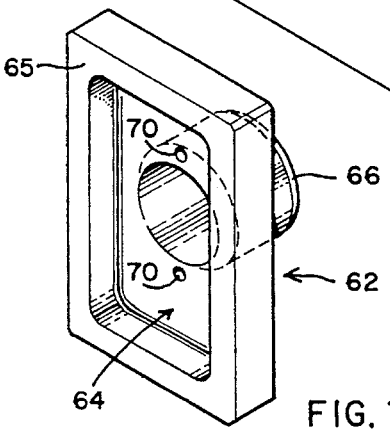
Figure 4:
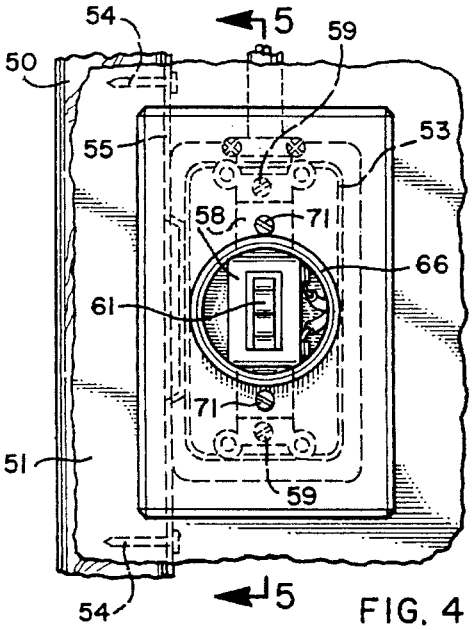
Figure 5:
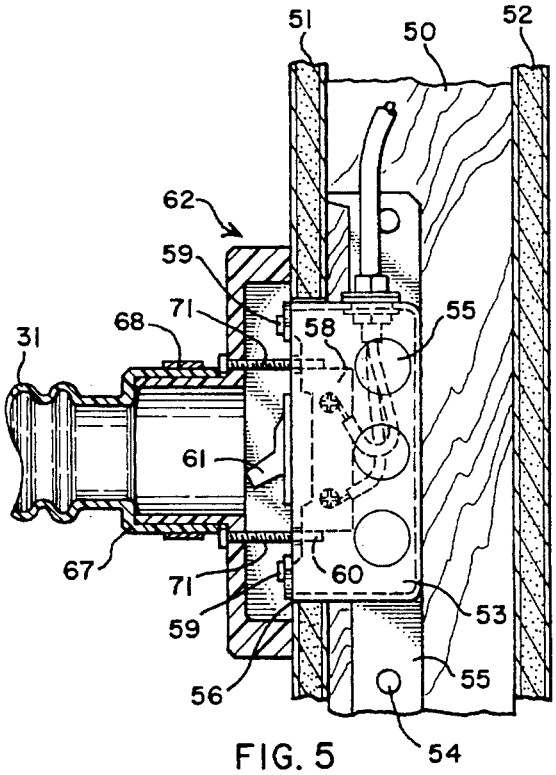

The basis of the invention is the finding that electrical boxes as generally installed in walls and ceilings, and sometimes in floors, open into the space behind the walls or ceiling between studs on which the wall or ceiling is mounted to an extent sufficient to allow air to flow through the electrical boxes into or out of the interior of the wall or ceiling for drying purposes. Typically, a wall is constructed with a series of spaced, vertically oriented studs, one stud 50 being shown in FIGS. 4–6, with plaster board 51 secured to one side of the stud to form a wall 30, FIG. 1, and plaster board 52 secured to the other side of the stud to form the other side of the wall. An electrical box, such as box 53, FIGS. 4–6, is secured to the side of stud 50 such as by nails 54 extending into stud 50 through standard box mounting bracket 55, FIGS. 4 and 5. The open face of box 53 usually projects into a hole or opening 56 in plaster board 51. Electrical box 53 will generally have holes or openings therein, such as holes 57, FIG. 5, through which wires can extend and through which air can pass from the box into the wall between plaster board 51 and 52. In addition, usually hole 56 in the plaster board will be somewhat larger than the perimeter of box 53 so there will be a small space between the box and the plaster board, at least at the corners as indicated in FIG. 1, where air can pass around the box into the wall. Also, in many cases, wiring will extend along the inside of the wall with holes drilled through the studs for the passage of such wires. Thus, if air is forced into a wall through or around an electrical box, it will circulate at least along and through parts of the walls or ceilings or floors. Such circulation will be similar to the circulation that could be obtained by cutting holes in the walls, ceiling, or floor and forcing air into the walls, ceiling, or floor through such holes. Similarly, if air is drawn out of a wall through or around an electrical box, the air drawn out will flow from and circulate along and through parts of the walls or ceilings or floors as it flows to and out of the electrical box.

In the particular arrangement of FIGS. 4–6, a standard electrical wall switch 58 for operating room lights is shown mounted in usual fashion in electrical box 53 by screws 59. For normal use, a standard switch cover plate, not shown, would be placed over box 53 and opening 56 and held in place by two screws which would extend into screw holes 60, FIG. 6, provided in switch 58 specifically for that purpose. Switch toggle 61 extends through a slot in the cover plate so is accessible to be operated by a user. These switches and cover plates are in universal common use in most buildings in the United States.

With the present invention, the standard switch cover plate is removed and a special apparatus or conduit 62, FIGS. 4–7, of the invention is secured over the electrical box 53 and opening 56. This is done without removal of the switch from the electrical box. Conduit 62 has an opening 64 in a first end 65 thereof. The outer dimensions and configurations of first end 65 are such that this first end will be bigger than and thus extend around opening 56 in plaster board 51 with the first end 65 abutting the wall or ceiling surface surrounding opening 56 and electrical box 53. Opening 64 confronts the open face of electrical box 53, and preferably is approximately coextensive with opening 56 in plaster board 51. Switch toggle 61 extends into opening 56. Conduit 62 has a second end 66 which is configured to be attached to a source of pressurized air. In the embodiments shown, second end 66 is configured as a nipple to receive a hose end 67 of a hose 31 thereover, FIGS. 5 and 6, (or a hose end 67 of hose 163) with a clamp 68 provided, if necessary, to securely clamp hose end 67 to nipple 66. Opening 64 in conduit body first end 65 extends into and through the second end 66 to form an air flow passage extending between and opening to the first and second ends of the conduit. Thus, conduit 62 serves as an adapter attached to the end of an air hose to fit the end over an electrical box and to secure the end to an electrical box.

Conduit body 63 includes two holes 70 therethrough which are spaced similarly to the two holes 60 in wall switch 58. With the first end of conduit body 63 placed over electrical box 53, and with wall switch 58 still secured in normal fashion therein, holes 70 through conduit body 63 are aligned with holes 60 of wall switch 58. Screws 71 are inserted through holes 70 and screwed into holes 60 just as screws holding a normal switch face plate would be. Thus, conduit 62 is a replacement for the face plate normally used for a wall switch and is easily secured over the wall switch.

To use the conduit apparatus 62 of the invention as shown in FIGS. 4–7, the normal wall switch face plate is removed and the conduit is placed over the switch and secured thereto with screws 71. The conduit first end 65 will extend against or abut the wall around the perimeter of the hole 56 with electrical box 53 therein to substantially restrict air flow between first end 65 and the wall. With a hose 31 secured to the second or nipple end 66 of the conduit, pressurized air as supplied by blower 20 will be forced into the wall through electrical box 53 and between electrical box 53 and the edges of box receiving hole 56. With a hose 163, FIG. 20, secured to the second or nipple end 66 of conduit 62, a partial vacuum is created by blower 20 which will draw air from the inside of the wall through electrical box 53 and between electrical box 53 and the edges of box receiving hole 56.

Figure 8:
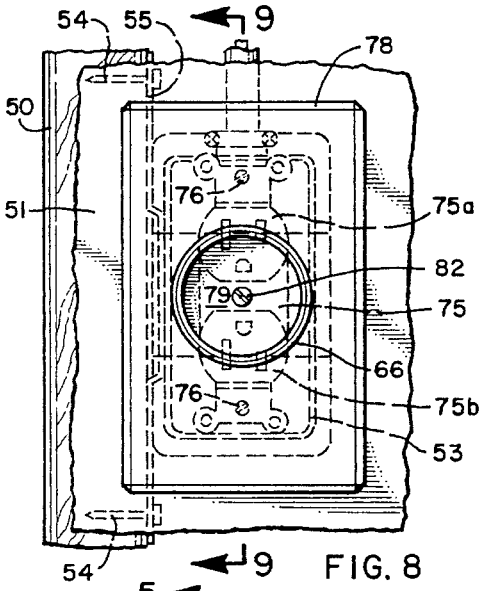
Figure 9:
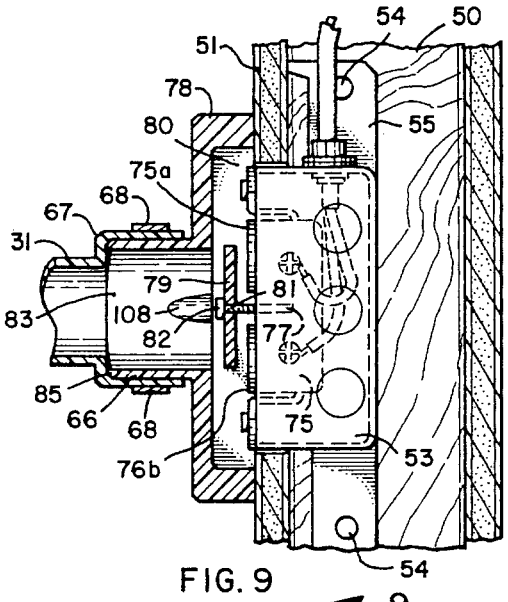

Rather than a wall switch being mounted in electrical box 53, a standard duplex outlet 75, FIGS. 8 and 9, could be mounted therein by screws 76. With a standard outlet, an outlet cover (not shown) is usually mounted over the electrical box 53 and mounting hole 56. In the case of an outlet, however, a single screw extends through the outlet cover to be screwed into a standard receiving hole 77 between the outlet faces 75*a* and 75*b*. FIGS. 8 and 9 show an embodiment of the conduit of the invention specifically configured to fit over a duplex outlet 75. Conduit body 78 includes a bar 79 extending centrally through opening 80 in the first end of the conduit, from side-to-side, with a hole 81 therethrough positioned to be aligned with the standard hole 77 in the outlet 75. A screw 82 is inserted through hole 81 and screwed into outlet hole 77 to secure conduit body 78 over the electrical box 53 as with the light switch. With the embodiment for use with an outlet, however, screw 82 is inserted through the air flow passage 83 from the opening in the second end 85 of the body. This has to be done before hose end 67 is placed over second end 85.

Figure 10:
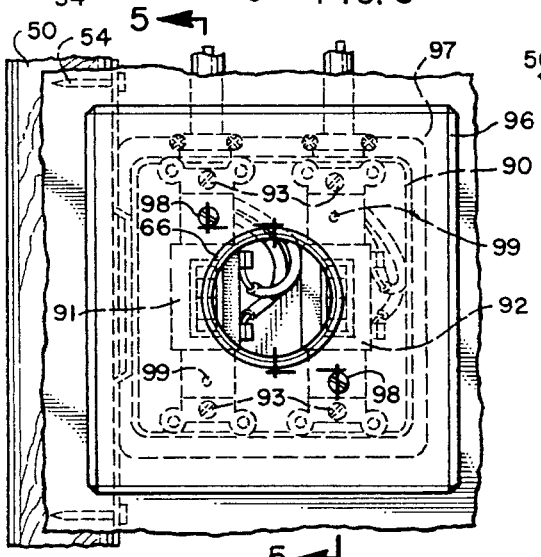
Figure 11:
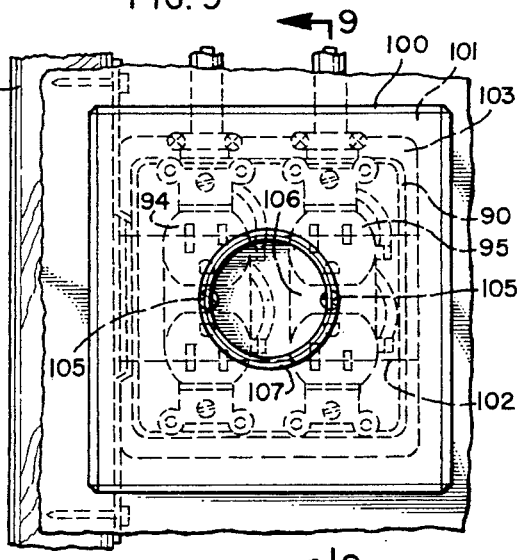

The electrical box 53 as shown in FIGS. 4–6 and 8 and 9 is a single box sized to accept one standard wall switch or one standard duplex outlet therein. Another commonly used electrical box is a double box 90 as shown in FIGS. 10 and 11. The double box is designed to hold two standard wall switches 91 and 92, FIG. 10, held in side-by-side relationship by screws 93 or two standard duplex outlets 94 and 95, FIG. 11, held in side-by-side relationship by screws 93. These double boxes 90 are secured to stud 50 in a wall in similar standard fashion as indicated for the single box, but the hole in the plaster board or other wall material is larger to accept the larger electrical box.

With two standard wall switches 91 and 92 in a box as shown in FIG. 10, a standard face plate is normally placed over the box and secured in place by four screws which are screwed into the standard screw holes 99 provided in the wall switches for that purpose. A conduit 96 of the invention specifically configured for use with double wall switches has a first end 97 sized to fit around a double electrical box as shown in FIG. 10. While four screw holes could be provided for four screws to extend into the four holes provided in the wall switches, two holes through which screws 98 can be inserted and screwed into two of the four standard wall switch screw holes 99 is generally satisfactory to secure conduit 96 over the electrical box. A vertical section through FIG. 10, as indicated by the line 5—5 on FIG. 10, would be substantially the same as the vertical section through a single wall switch conduit as shown in FIG. 5, however, FIG. 5 is numbered for FIG. 4 rather than for FIG. 10.

With two standard duplex outlets 94 and 95 mounted in box 90 as shown in FIG. 11, a standard outlet cover is normally placed over the box and secured in place by two screws which are screwed into the standard screw holes provided in the outlets. A conduit 100 of the invention specifically configured for use with double outlets has a first end 101 sized similarly to that of conduit 96 to fit around a double electrical box as shown in FIG. 11. In this case a bar 102, similar to bar 79 of FIGS. 8 and 9, extends through the opening 103 in first end 101 with holes therein positioned to be aligned with the standard outlet holes so that screws 105 can be inserted through such holes and screwed into the standard outlet holes to secure conduit 100 over the outlets. Screws 105 are inserted from inside the opening 106 in the second end 107 of conduit 100. Again, a vertical section taken on the line 9—9 of FIG. 11 will be substantially the same as a vertical section through a single outlet conduit as shown in FIG. 9, however, FIG. 9 is numbered for FIG. 8 rather than FIG. 11, except that indentation 108 in FIG. 9 (a similar indentation is provided on the corresponding opposite inside portion of conduit 100 not shown) represents an indentation in the conduit 100 of FIG. 11, to make it easier to insert screws 105 through bar 102 and into the side-by-side socket holes.

In some cases, triple boxes are used to mount three wall switches in the wall of a room. A similar attachment configured to fit over and be secured to the light switches in a triple box could be provided.

Figure 12:
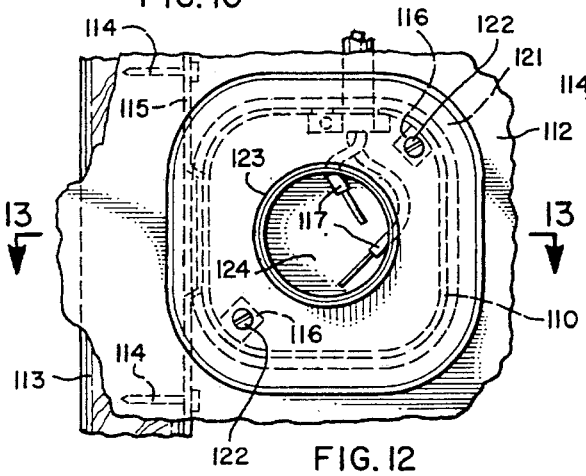
Figure 13:
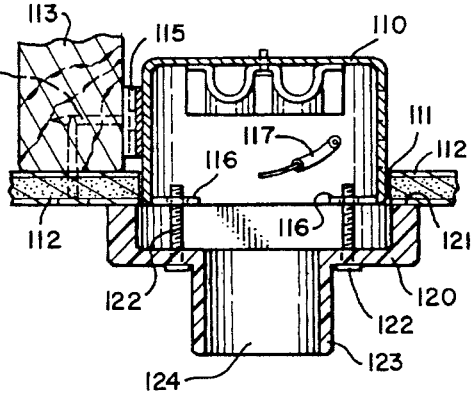
Figure 14:
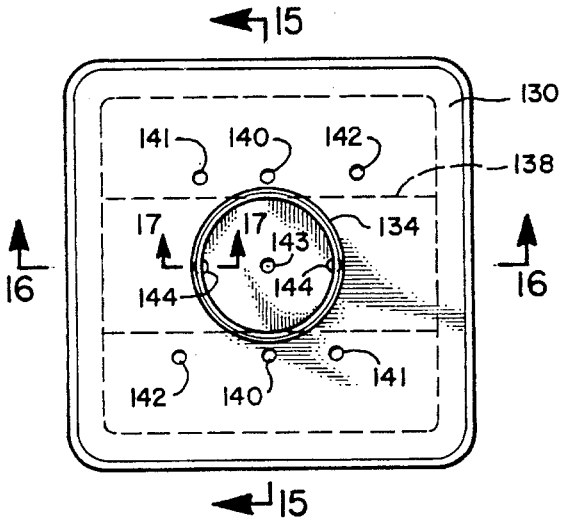
Figure 15:
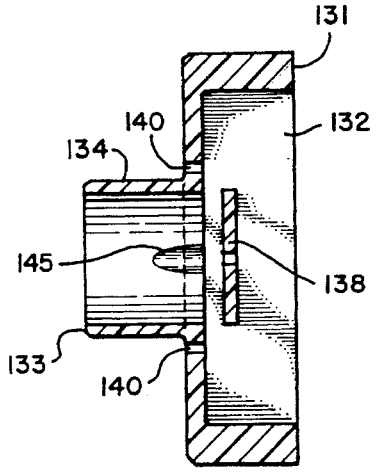
Figure 16:
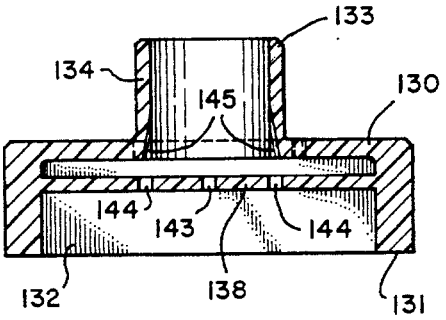
Figure 17:
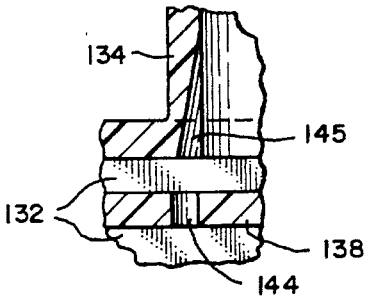
Figure 18:
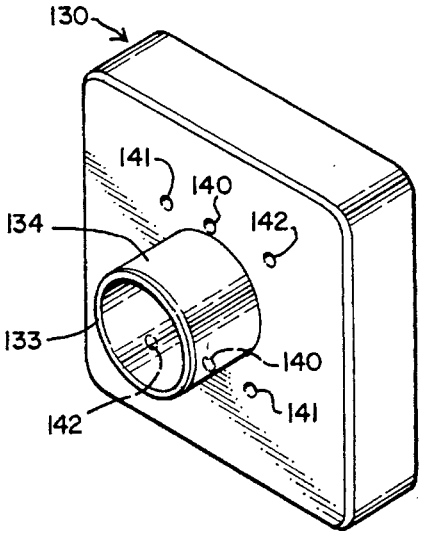
Figure 19:
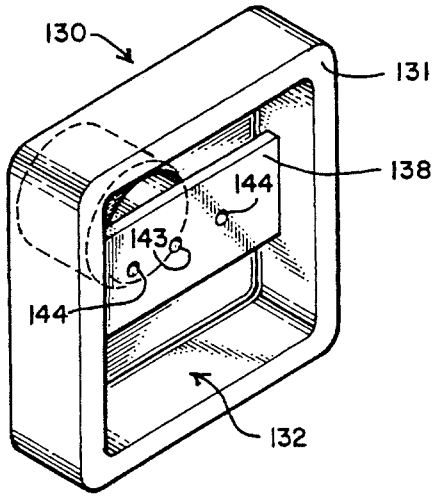

In the case of light fixtures in a ceiling, as shown in FIGS. 12 and 13, an electrical box 110 is usually mounted in a hole 111 in the ceiling 112 and is secured to a ceiling beam 113 such as by nails 114 extending through a usual mounting bracket 115. A ceiling light fixture (not shown) is usually secured over the box on the ceiling by two screws threaded into holes in box tabs 116. The building wiring 117 is usually connected to the light fixture wiring (not shown) in the electrical box 110 generally using wire nuts (not shown). For forcing air into a ceiling or for drawing air from a ceiling, the light fixture is removed from over the box by unscrewing the screws and the wires disconnected so that the fixture is removed from the box and the ceiling. A conduit 120 of the invention with a first end 121 sized and configured to fit over and around electrical box 110 and ceiling opening 111 is positioned over box 110. Holes are provided through conduit 120 aligned with the standard holes in tabs 116 and screws 122 are inserted through the holes in the conduit and screwed into the holes in tabs 116 as shown in FIGS. 12 and 13 to secure conduit 110 to the electrical box so that the first end 121 thereof abuts the ceiling 112 peripherally around ceiling hole 111. As with the other embodiments of the conduit of the invention, the second end 123 of the conduit is configured to receive the end of a hose supplying pressurized drying air or the end of a hose connected to a source of partial vacuum. An air passage 124 extends from communication with the second end of the conduit to the first end of the conduit where it opens through the first end in confronting relationship to the box 110 and ceiling opening 111.

As described so far, a separate embodiment of the invention has been provided for each separate size of electrical box and for mating with wall switches or outlets mounted in such boxes. A further embodiment of conduit of the invention is sized and configured to be used universally with any one of the one switch or one outlet size box, two switch or two outlet size box, or the normal ceiling fixture box. As shown in FIGS. 14–19, a conduit 130 has a generally rectangular first end 131 and generally rectangular opening 132 therein. Thus, first end 131 forms a rectangular flat surface extending around opening 132 and adapted to abut a wall, ceiling, or floor peripherally around an electrical box of single or double switch or outlet size, or of ceiling box size, with the box and wall, ceiling, or floor hole for the box opening into and communicating with the conduit opening 132. The second end 133 of the conduit is formed as a nipple 134 to receive the end of an air hose thereon, as with the previously described embodiments. As with the embodiments of FIGS. 8, 9, and 11, a bar 138 extends through opening 132.

In order to secure the conduit 130 over a variety of electrical boxes, a plurality of mounting holes is provided for selective use depending upon the particular arrangement of switches, outlets or light fixtures in the electrical box to be covered. Two holes 140 are provided to align with the holes of a single wall switch. To mount conduit 130 over a single wall switch screws are extended through holes 140 into the standard threaded receiving holes in the wall switch. Holes 141 are aligned with two of the holes of a side-by-side arrangement of wall switches and would provide the mounting screw arrangement of FIG. 10. Holes 142 are aligned with the holes provided in the tabs of a standard ceiling box and provide the mounting screw arrangement of FIGS. 12 and 13. Central hole 143 in bar 138 provides for mounting over a single duplex outlet as in FIGS. 4–6. Holes 144 in bar 138 provide for mounting over a side-by-side arrangement of outlets as shown in FIGS. 8 and 9. Again, indentations 145 in the inside surface of conduit 130 provide more room for mounting of screws through holes 144.

While with any of the mountings of conduit 130 over an electrical box several or all of the holes 140–142 will be open and allow communication between the opening 132 and the outside atmosphere, it has been found that the size of such holes does not allow enough pressurized air to escape to interfere with the flow of air into the walls or ceiling or to allow enough air to be drawn into the hose to interfere with the flow of air drawn from the walls or ceiling. Thus, the presence of these open holes is not a problem.

Figure 23:
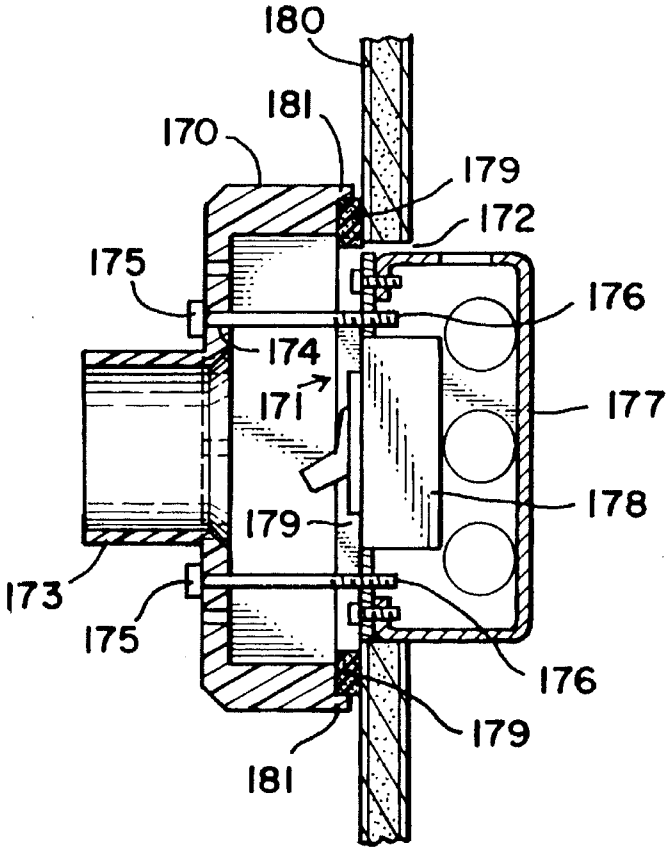
Figure 22:
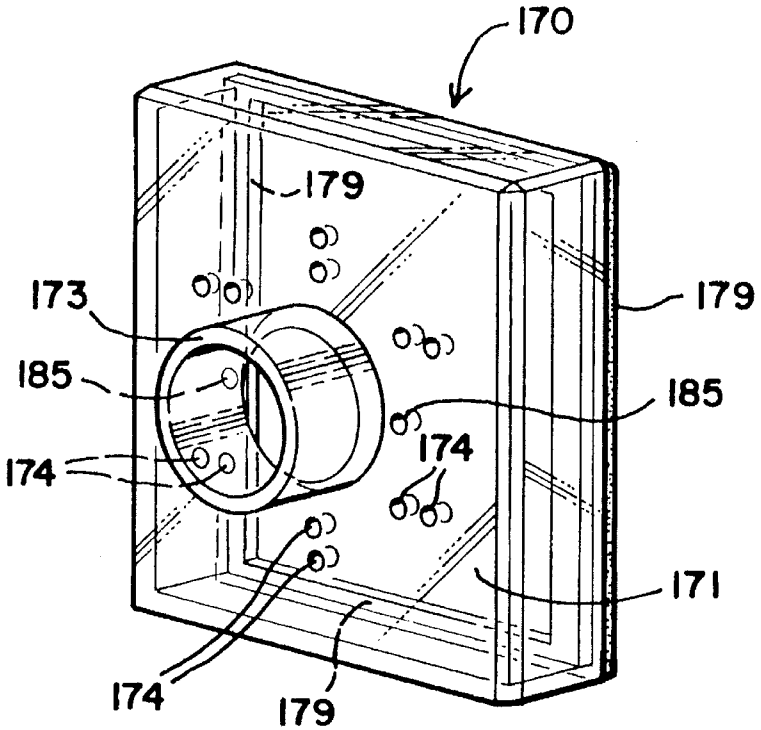

A further embodiment of conduit of the invention which eliminates the need for a bar, such as bar 138 in FIGS. 14–19, and which includes elastomeric material about its first end for facilitating installation over a variety of electrical boxes installed at a variety of depths in a wall, is shown in FIGS. 22 and 23. Conduit 170 has a generally rectangular first end having a generally rectangular opening 171 therein that fits about an opening in the wall 172 containing an electrical box of single or double switch or outlet size, or of ceiling box size, as with the embodiment of FIGS. 14–19. The conduit has a second end 173 in the shape of a nipple and adapted for attachment of an air supply or vacuum hose. The conduit is provided with a plurality of mounting holes 174 in various patterns such that the conduit may be attached to a variety of electrical boxes of single or double switch or outlet size, of ceiling box size, or to switches mounted in an electrical box. In addition, holes 185 are provided for securing the conduit to a variety of outlets mounted in electrical boxes. If a single duplex outlet is to be covered, the conduit 170 is placed off-center over the outlet so that one of the holes 185 is aligned with the cover mounting hole in the outlet. With double outlets, generally holes 185 will be spaced so that they overlie the cover mounting holes in each of the outlets, although a single hole 185 could be aligned with the hole in one of the outlets to accept the securing screw. Conduit 170 may also be provided with a resilient seal material 179, such as foam weatherstrip material, secured to the first end about opening 171.

Generally, it is preferred that mounting screws 175 not extend unduly far into an electrical box 177, FIG. 23, when the conduit 170 (or conduits of other embodiments) is installed over the opening 172 in the wall. Should screws 175 extend deeply into the box, they may contact and displace wires in the box. Also, with some boxes, screws can only be inserted to a limited depth. In addition, the farther the screws 175 extend into the box 177, the more turns, and therefore time, required for tightening the screws while installing conduit 170 over the opening 172 in the wall. While electrical boxes 177 are required by building codes to be installed at a standard depth in the opening 172 in a wall, in practice, considerable variation has been found in the depth of boxes 177.

Provision of a thickness of resilient material 179, particularly of a relatively easily compressed foam seal material, permits use of conduit 170 with mounting screws 175 of a single, fixed length even if the electrical box 177 or electrical device 178 is not set at the exact standard depth in the opening 172 in the wall. In the event that the box 177 has been mounted shallowly in opening 172, i.e., the front of the box extends out slightly further than the surrounding wall surface, the foam seal material need not be compressed while installing conduit 170 over the opening 172. The uncompressed foam seal material 179 will suffice to direct most of the airflow through the electrical box 177 and its mounting opening 172. Should the box 177 be mounted deeply in opening 172, i.e., the front of the box is behind the surrounding wall surface, the foam seal material may be compressed to reduce the distance from the screw holes 174 and 185 in the conduit 170 to the wall surface 180, thereby allowing the single length mounting screws 175 to reach the threaded screw receiving holes 176.

A lip 181 may be provided about the outside circumference of the first end of conduit 170. The lip 181 helps to guide installation of the foam seal material 179 about opening 171 of conduit 170, and also protects the foam seal material and helps hold it from being knocked off of the front end of conduit 170. It may also serve to help retain foam seal material 179 about opening 171 when pressurized air is applied to conduit 170.

The present invention accelerates drying of a wall or ceiling by inducing an exchange of moisture saturated air from the space within the wall or ceiling with unsaturated air from the environment. As indicated, the exchange of air can occur by forcing air into the wall or by drawing air out of the wall. A combination can also be used where one blower unit 20 can be used to force air into a wall or ceiling through some electrical boxes, while a second blower unit 20 can be used to draw air out of the wall or ceiling at different locations through other electrical boxes. A dehumidifier can be provided in the room to remove moisture from the air before it enters the wall. Air forced into a wall could come from a remote location outside the room having air drier than the air in the room being dried.

The conduits of the invention are preferably made from a clear plastic material so that a user can see through the conduit and thereby guide the mounting screws through the mounting holes in the conduit to the threaded screw-receiving holes in either the electrical box or the electrical devices mounted in the electrical box to which the conduit is to be secured.

While the conduits shown all have generally rectangular first ends, various other shapes, such as circular could be used. This is particularly the case if the conduit is to be used over a circular electrical box such as sometimes used in ceilings. Also various transitions between the first end and second ends could be used with various configurations used at the second end for coupling to an air hose.

Further, while the conduits have been shown as secured around the electrical boxes with screws attaching the conduits to a wall switch, outlet, or the box itself, other means could be provided to secure the conduit to an electrical box such as arms extending from the conduit to fit inside the electrical box to removably hold the conduit thereto. The conduit can be constructed of plastic or other materials or can be molded of a plastic material.

Devices for generating an air pressure differential, i.e., pressurized air or partial vacuum other than the centrifugal-flow blower unit 20 shown may be used in the present invention. It is important that the pressure difference of the partial vacuum or pressurized air be sufficiently low that the difference in pressure across plasterboard 51 will not cause damage to the plasterboard 51. Similarly, a spring catch as commonly used with vacuum cleaner hoses may be used to retain the hoses on nipples and conduits in lieu of the hose clamps 47 and 68 shown.

While electrical boxes have been described specifically as those boxes for mounting electrical wall switches and outlets, electrical boxes include various other electrical boxes or similar boxes installed in walls, ceilings, or floors could be used, such as those which house telephone jacks, television cables, video cables, or computer cables.

Further, if desired to bias the conduit against a wall around the box and opening therefor, springs could be provided between the conduit and the heads of the screws securing the conduit to the boxes. Other bias means could also be used.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. Apparatus for applying a partial vacuum to a hollow wall or ceiling through an opening in the wall or ceiling with a surface of the wall or ceiling extending around an open face of the opening, comprising:

a conduit body having a first end sized and configured to fit circumferentially around the open face of a given opening and a second end configured to be coupled to a source of a partial vacuum;

an air flow passage extending between and opening to the first and second ends whereby a partial vacuum applied to the air flow passage through the second end is directed to and causes a reduction in air pressure at the first end; and means for securing the conduit body over the open face of a given opening so that the first end will substantially abut the surface around the opening.

2. Apparatus for applying a partial vacuum to a hollow wall or ceiling according to claim 1, wherein the opening has an electrical box secured therein.

3. Apparatus for applying a partial vacuum to a hollow wall or ceiling according to claim 2, wherein the means for securing the conduit body over the open face of the opening is at least one hole through which a mounting screw can pass.

4. Apparatus for applying a partial vacuum to a hollow wall or ceiling according to claim 3, wherein the electrical box over which the conduit body is to be secured is an electrical box having a single wall switch mounted therein, and the at least one hole is a pair of holes positioned to be aligned with the usual pair of switch plate mounting holes provided in the wall switch when the conduit is in position over the electrical box.

5. Apparatus for applying a partial vacuum to a hollow wall or ceiling according to claim 3, wherein the electrical box over which the conduit body is to be secured is an electrical box having two side-by-side wall switches mounted therein, and the at least one hole is a pair of holes positioned to be aligned with two of the usual pair of switch plate mounting holes provided in each of the wall switches when the conduit is in position over the electrical box.

6. Apparatus for applying a partial vacuum to a hollow wall or ceiling according to claim 3, wherein the electrical box over which the conduit body is to be secured is an electrical box having mounting holes therein for mounting an electrical fixture, and the at least one hole is a pair of holes positioned to be aligned with the mounting holes in the electrical box when the conduit is in position over the electrical box.

7. Apparatus for applying a partial vacuum to a hollow wall or ceiling according to claim 3, wherein the electrical box over which the conduit body is to be secured is an electrical box having a single standard duplex outlet mounted therein, and the at least one hole is a hole positioned to be aligned with the usual cover plate mounting hole provided in the outlet when the conduit is in position over the electrical box.

8. Apparatus for applying a partial vacuum to a hollow wall or ceiling according to claim 7, wherein a bar extends through the air flow passage and the at least one hole extends through the bar.

9. Apparatus for applying a partial vacuum to a hollow wall or ceiling according to claim 3, wherein the electrical box over which the conduit body is to be secured is an electrical box having two side-by-side standard duplex outlets mounted therein, and the at least one hole is a pair of holes positioned to be aligned with the usual cover plate mounting holes provided in the two outlets when the conduit is in position over the electrical box.

10. Apparatus for applying a partial vacuum to a hollow wall or ceiling according to claim 9, wherein a bar extends through the air flow passage and the at least one hole extends through the bar.

11. Apparatus for applying a partial vacuum to a hollow wall or ceiling according to claim 2, wherein the second end is configured as a nipple over which the end of a vacuum supply hose can be secured.

12. Apparatus for applying a partial vacuum to a hollow wall or ceiling according to claim 11, additionally including a hose mounting plate adapted to be secured over an inlet end of an air blower, means for securing the hose mounting plate over the inlet end of an air blower, nipple means extending from the hose mounting plate for securing at least one air hose to the hose mounting plate to receive a partial vacuum from the blower, and air hose means connected at one end to the nipple means extending from the hose mounting plate and at the other end to the second end of the conduit.

13. Apparatus for applying a partial vacuum to a hollow wall or ceiling according to claim 2, additionally including a hose mounting plate adapted to be secured over an inlet end of an air blower, means for securing the hose mounting plate over the inlet end of an air blower, means for securing at least one air hose to the hose mounting plate to receive air from the blower, and air hose means secured at one end to the hose mounting plate and at the other end to the second end of the conduit.

14. Apparatus for applying a partial vacuum to a hollow wall or ceiling according to claim 2, wherein the first end is substantially rectangular in shape to fit around the open face of a substantially rectangular electrical box.

15. A method of creating air flow in a hollow wall or ceiling having an electrical box installed therein with an open face thereof in a receiving hole in the wall or ceiling which has a surface surrounding the open face of the box, comprising the steps of exposing the face of an electrical box; securing a conduit apparatus having an end adapted to fit around the face of the electrical box over the box so that the conduit apparatus abuts the surface surrounding the face of the box and an air flow passage in the conduit opens to the face of the box; and supplying a partial vacuum to the conduit apparatus whereby the partial vacuum draws air from the wall or ceiling through and around the electrical box.

16. A method of creating air flow in a hollow wall or ceiling comprising the steps of providing an opening in the wall or ceiling; securing a conduit apparatus having an end adapted to fit around the face of the opening over the opening so that the conduit apparatus abuts the surface surrounding the opening and an air flow passage in the conduit opens to the face of the opening; and supplying a partial vacuum to the conduit apparatus whereby the partial vacuum draws air from the wall or ceiling through and around the opening.

17. The method of claim 16 wherein the step of providing an opening in the wall or ceiling further comprises the step of removing a cover plate from an electrical box, and wherein the opening comprises the receiving hole surrounding the open face of an electrical box.

* * * * *